US009181765B2

(12) United States Patent
Ferrari

(10) Patent No.: US 9,181,765 B2
(45) Date of Patent: Nov. 10, 2015

(54) PARKING AND AUTOMATIC HANDLING EQUIPMENT OF DRILLING RODS AND ASSOCIATED DRILLING MACHINE

(75) Inventor: Stefano Ferrari, Barbiano (IT)

(73) Assignee: DRILLMEC S.P.A., Gariga di Podenzano (IT)

( * ) Notice: Subject to any disclaimer, the term of this patent is extended or adjusted under 35 U.S.C. 154(b) by 283 days.

(21) Appl. No.: 13/818,976

(22) PCT Filed: Aug. 4, 2011

(86) PCT No.: PCT/IB2011/001830

§ 371 (c)(1),
(2), (4) Date: May 6, 2013

(87) PCT Pub. No.: WO2012/025804

PCT Pub. Date: Mar. 1, 2012

(65) Prior Publication Data

US 2013/0213715 A1 Aug. 22, 2013

(30) Foreign Application Priority Data

Aug. 25, 2010 (IT) ..... TO2010A0711

(51) Int. Cl.
*E21B 19/14* (2006.01)

(52) U.S. Cl.
CPC ..... *E21B 19/146* (2013.01); *E21B 19/14* (2013.01)

(58) Field of Classification Search
USPC ..... 175/52; 414/22.61, 22.63, 22.65, 22.66, 414/22.68
See application file for complete search history.

(56) References Cited

U.S. PATENT DOCUMENTS

| | | | | |
|---|---|---|---|---|
| 4,708,563 | A | 11/1987 | Van Den Berg et al. | |
| 6,763,898 | B1 | 7/2004 | Roodenburg et al. | |
| 6,857,483 | B1 * | 2/2005 | Dirks et al. | 175/52 |
| 2009/0196712 | A1 * | 8/2009 | Mortensen et al. | 414/22.68 |
| 2010/0012376 | A1 * | 1/2010 | Bagassi | 175/24 |

FOREIGN PATENT DOCUMENTS

| | | |
|---|---|---|
| EP | 0 228 907 | 7/1987 |
| EP | 0 979 924 | 2/2000 |
| WO | WO 2010126357 A1 * | 11/2010 |

OTHER PUBLICATIONS

International Search Report for International Application No. PCT/IB2011/001830 mailed Nov. 10, 2011.

* cited by examiner

*Primary Examiner* — David Andrews
*Assistant Examiner* — Kyle Armstrong
(74) *Attorney, Agent, or Firm* — Merchant & Gould P.C.

(57) ABSTRACT

Parking and automatic handling equipment of drilling rods (10) includes a carousel (20) of containers (30) of drilling rods (40); and a rod handling system (100), positioned on a drilling machine. A handling arm (101) transfers the drilling rods (40) out of the carousel (20). The carousel (20) defines a closed path around which are arranged the containers (30) of drilling rods (40); the carousel (20) includes an internal structure (22) for supporting the containers (30) movable on a closed path.

8 Claims, 10 Drawing Sheets

22
23
27
A
22
22d
A
22s
23
23a
23b
23c

PARKING AND AUTOMATIC HANDLING EQUIPMENT OF DRILLING RODS AND ASSOCIATED DRILLING MACHINE

This application is a National Stage Application of PCT/IB2011/001830, filed 4 Aug. 2011, which claims benefit of Serial No. TO2010A000711, filed 25 Aug. 2010 in Italy and which application(s) are incorporated herein by reference. To the extent appropriate, a claim of priority is made to each of the above disclosed applications.

BACKGROUND OF THE INVENTION

The present invention relates to the field of handling equipment of rods and additional devices for the ground drilling; in details, the present invention relates to a parking and automatic handling equipment of drilling rods. The present invention relates also to a drilling machine associated to the above mentioned equipment.

It is known that parking and drilling rods handling equipments are known from the patent EP1158136, which shows a solution wherein a storage of drilling rods comprises containers radially positioned along a circumference arch or semicircle.

However, from the EP1158136 arises some drawbacks.

First of all, the number of rod containers and their storage capacity is limited by the semicircular arrangement; as a matter of fact in this case each sector of containers is arranged in radial direction and all the transversal axis of the containers themselves pass by the rotation centre of the automatic handling arm; for this reason, if the number of the drilling rods stored in the storage is to be increased, the semicircle has to be enlarged.

However, the enlargement of the semicircle is not at all manageable at will; as a matter of fact, with the enlargement of the semicircle, it is also necessary to increase the horizontal excursion of the arm of the handling arm which draws and positions the drilling rods in the containers; the limit is given by the fact that it is reached a determined length of the arm wherein, for reaching the rods in the rod container of the storage, once completely retracted, the arm would hit the container positioned in the diametrically opposed direction.

Is also known, from the patent application U.S. Pat. No. 6,763,898, a multiple lift hoist system for a drilling vessel and use on land. Said system comprises a mast with a top side and a base connected to a drilling vessel, a first and second hoisting device at the top side of the mast; a lift system with a first hoisting device located in a first firing line that manipulates a first drill string and a second hoisting device located in a second firing line that manipulates; a second drill string both hoisting devices move the strings in the longitudinal direction of the mast, and a plurality of cables and winches disposed in the hollow construction to manipulate the position of the first and second hoisting devices relative to the mast so the first and second firing lines are accessible from the outside of the mast.

Secondly, the arrangement for the containers in front of the drilling machine requires that there is free space in front of the well within which the drilling rods are inserted; this arrangement is not possible if the equipment is susceptible of operating on aligned wells (the so-called cluster wells), that is close the one with respect to the other.

SUMMARY OF THE INVENTION

The purpose of the present invention is then to describe a parking and automatic handling equipment of drilling rods which is free from the above described inconvenients.

The purpose of the present invention is also to describe a drilling machine which is free from the above described drawbacks and is equipped with a parking and automatic handling equipment of drilling rods according to the present invention.

According to the present invention it is realized a parking and automatic handling equipment of drilling rods.

According to the present invention it is also realized a drilling machine which comprises a parking and automatic handling equipment of drilling rods according to the present invention.

BRIEF DESCRIPTION OF THE DRAWINGS

The invention will be now described with reference to the attached drawings, which show a non limiting example of embodiment, wherein.

DETAILED DESCRIPTION OF THE PREFERRED EMBODIMENTS

Figure 1:
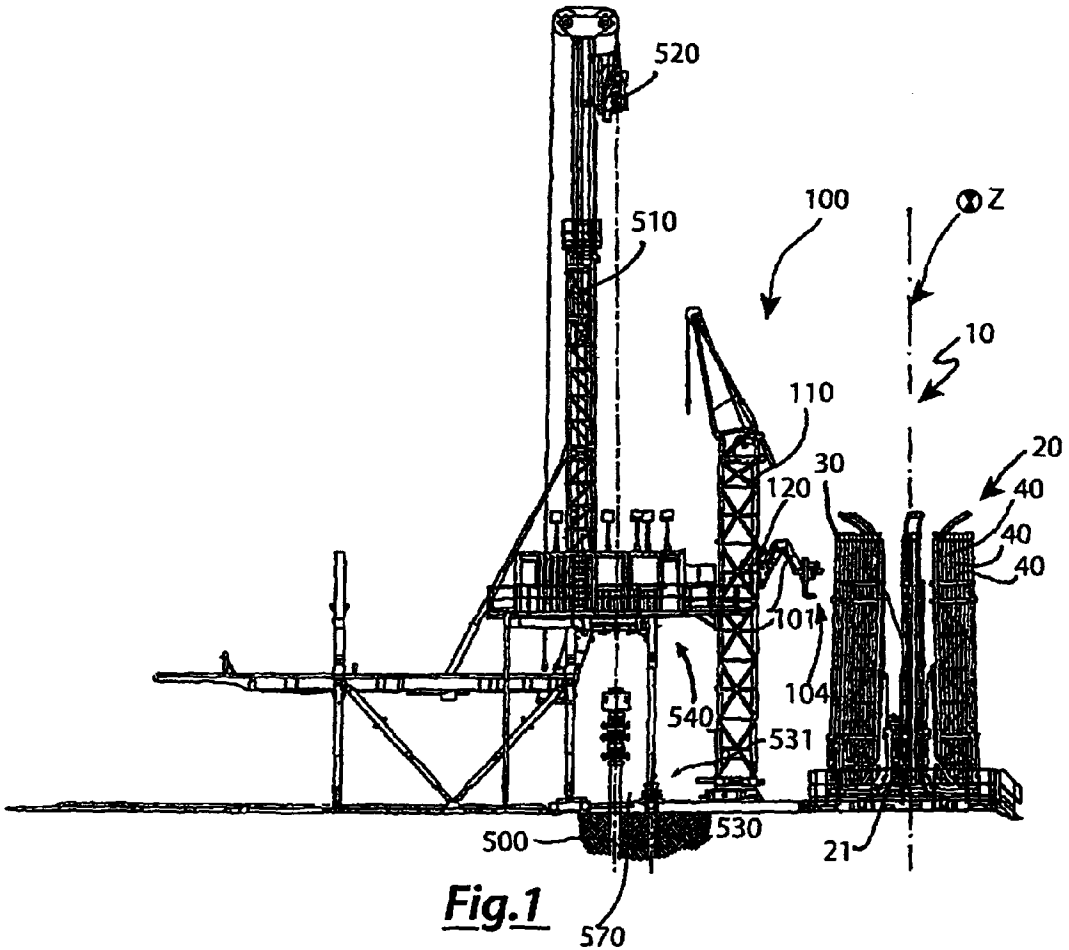
FIG. 1 shows a lateral view of a parking and automatic handling equipment of drilling rods in a first embodiment according to the present invention.

With reference to FIG. 1, a parking and automatic handling equipment of drilling rods is generally indicated with 10.

Equipment 10 comprises a carousel 20 of containers 30 of drilling rods. 40; carousel 20 comprises also a base formed by a plurality of elements 21 (or platforms) positioned in one lower ending zone and which divides it from the ground.

Figure 2:
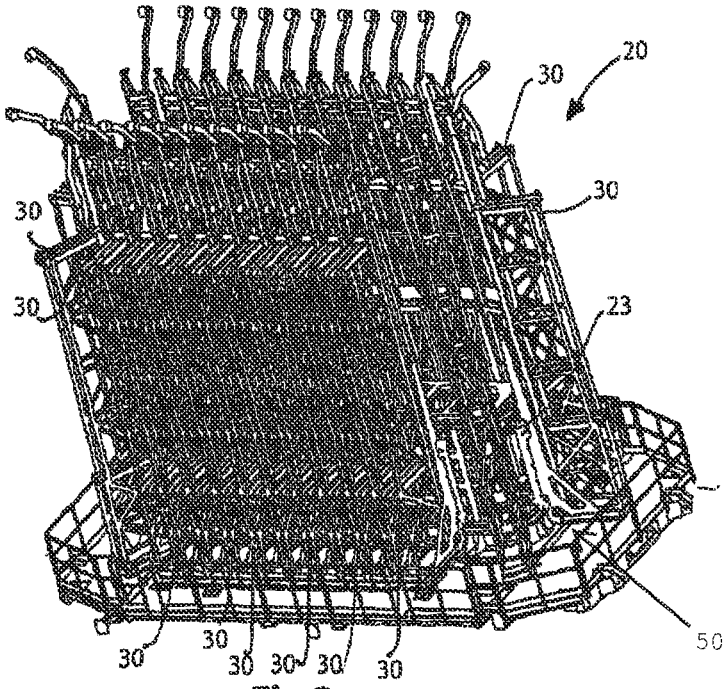
FIG. 2 shows a perspective view of a carousel of storage for drilling rods according to the present invention.
Figure 3:
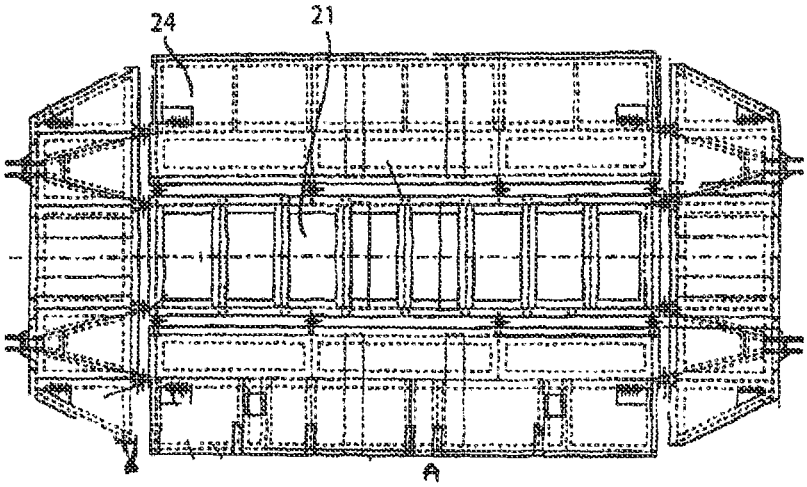
FIG. 3 shows a plan view of part of the carousel of FIG. 2.

As shown in detail in FIGS. 2 and 3, carousel 20 comprises also an internal structure 22 of metal carpentry, which in use extends vertically with respect to the ground that is along a first axis Z and whose purpose is to provide for a support to the plurality of containers 30.

Therefore, carousel 20 defines then a closed path around which are radially arranged all containers 30.

Figures 4, 5, 6:
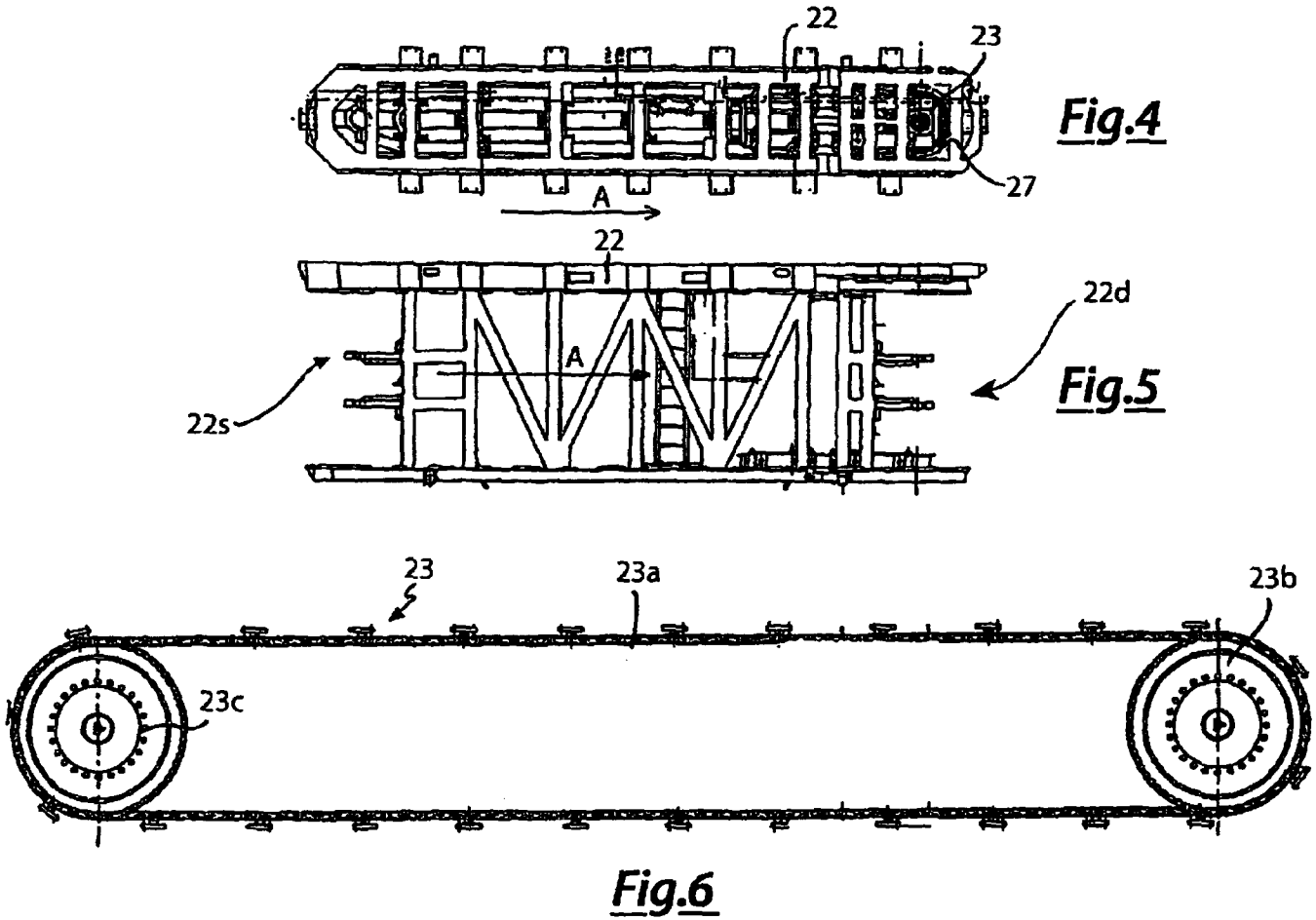
FIG. 4 shows a plan view of a central structure of the carousel of FIG. 2.
FIG. 5 shows a lateral view of the central structure of FIG. 4.
FIG. 6 shows a transmission chain and the related toothed wheels of the carousel of FIG. 1.

As shown in details in FIGS. 4, 5, 6, carousel 20 comprises also a transmission group 23 for handling containers 30 of drilling rods 40, which are not anymore radially arranged along a circumference, but are on the other hand arranged along an oblong path, finding then a direction A of maximum extension of carousel 20, having two straight sides and two semicircular endings, finding also a typical path which is delineated by a chain 23*a* geared upon a pair of gears 23*b*, 23*c* opposed and mounted in correspondence to a left, right side ending 22*s*, 22*d* of internal structure 22.

Elements 21 are carpentry structures opportunely sized for facilitating their transport and reciprocally connected during the mounting through pins. Each of elements 21 is positioned on at least a base beam 24, which realize a sliding translation system (skidding) and which are leaned directly on the ground which has been previously leveled with a reinforce concrete slab in order to ensure the correct functioning of the carousel itself 20 and to avoid force overloads to transmission group 23.

Through the planarization of the ground with reinforced concrete, it is then ensured the vertical orientation of containers 30 with respect to the ground.

Internal structure 22 is leaned and fastened through bolts to base elements 21 and comprises a central body, a first semicircular head integral with the central body itself and a second semicircular head opposed to the first and adjustable in distance with respect to the central body.

As it can be noticed in FIG. 6, transmission group 23 comprises as already mentioned, transmission chain 23*a* which is engaged on respectively the first and second toothed wheels 23*b*, 23*c* which are mounted in correspondence of the respective first and second semicircular head of internal structure 21, thus resulting positioned at the ending of the axis of the higher horizontal extension of internal structure 21 itself. Therefore, both toothed wheels 23*b*, 23*c* rotate around a respective axis parallel to axis Z.

Even if transmission chain 23*a* can be of different kinds, this chain is preferably a roller chain.

Furthermore, transmission group 23 can comprise also a second and a third chain 23*a*, also positioned in such a way as to engage on toothed wheels coaxially mounted with respect to the first and second toothed wheel 23*b*, 23*c*; the final number of chains will depend on the size and the weight, as well as the number of containers 30 of drilling rods 40.

In correspondence of the heads are also present gear motors 27, comprising also an electric motor operated by an inverter and a reducer, connected with an output shaft to a pinion in turn geared with the toothed wheels.

Figure 7:
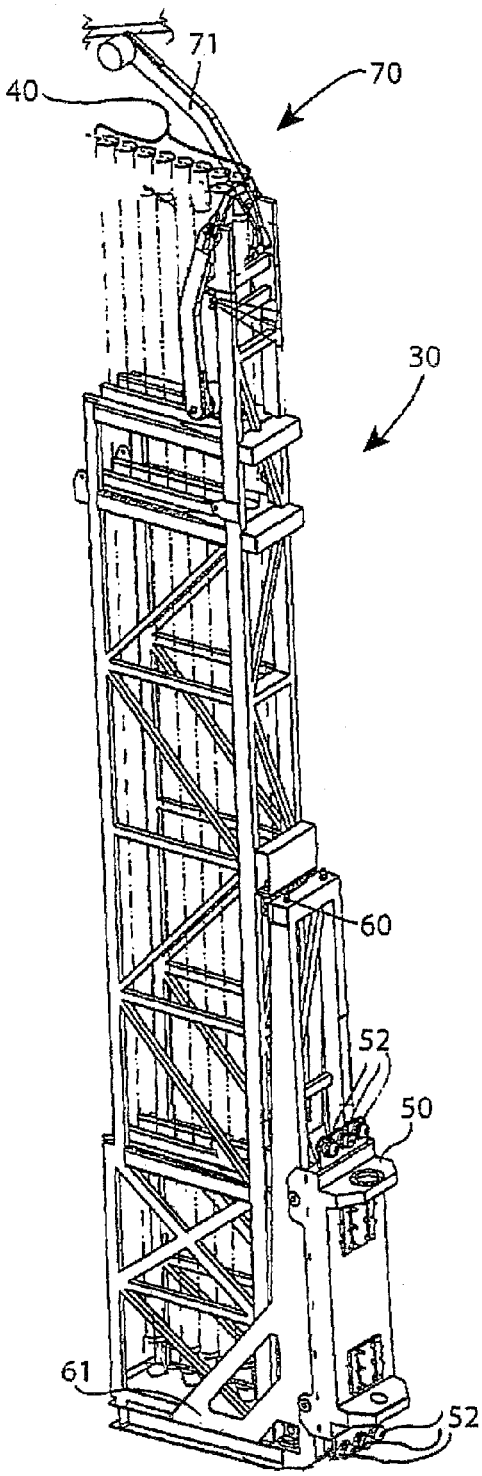
FIG. 7 shows a container of drilling rods and a handling carriage of it according to the present invention.
Figure 8:
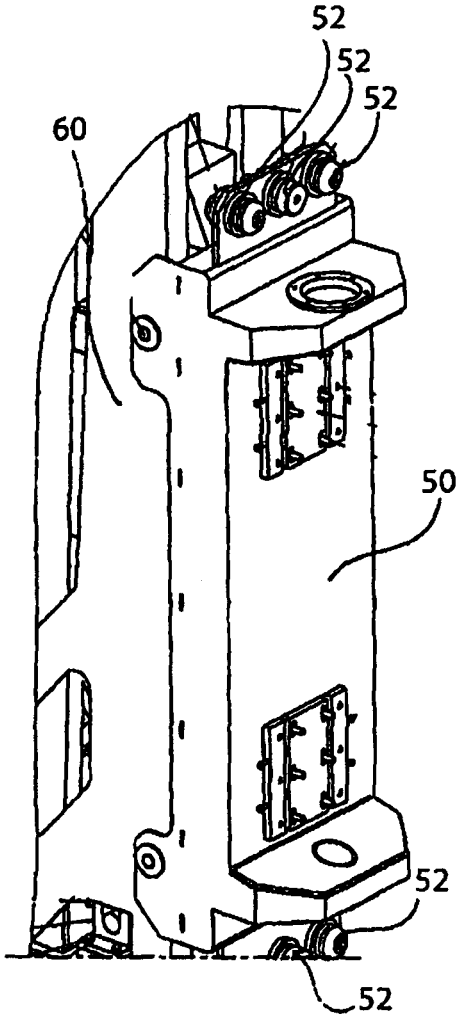
FIG. 8 shows a detail of a supporting carriage of the rod container shown in FIG. 7.

As shown with higher details in FIG. 7 and in FIG. 8 (detail of the carriage of FIG. 7), all around central structure 21 is positioned a plurality of carriages 50, which permit the support of containers 30 of drilling rods 40. Each of carriages 50 comprises:

- elements with a plane rectangular flange which are used for engaging on at least one of transmission chains 23*a*; each of the elements with a plane rectangular flange comprises a plurality of rear wings inserted each one in a respective mesh of chain 23*a;*
- a plurality of guide wheels 52, rotating along an axis orthogonal to axis Z, which also engage in structures rigidly constrained to internal structure 22 of carousel 20;
- a respective saddle or L-structure 60, extending along a first and higher direction in use parallely to axis Z and having a base 61 lying on a plane found by a pair of axis orthogonal to axis Z itself.

Saddle structure 60 enables the fastening of a rod container 30, which is preferably, but not limiting to, subdivided into two sectors each one housing a same number of drilling rods 40. If container 30 is able to house two or more rod rows, these rows are parallel.

In correspondence of the top of each container 30 there is a pair of fall-prevention devices 70, in number equal anyway to one for each row of drilling rods.

Each fall-prevention device comprises an arm 71 rotating around a horizontal axis and having a counterweight, which has in correspondence of one first ending, a roller having a width equal to the diameter of drilling rods 40.

The fall-prevention device comprises a first position of use and a second position of use and through the rotation of rotating arm 71 it is possible to configure alternatively fall-prevention device 70 in a position selected between the first and the second position of use.

When rotating arm 71 is positioned in a first position of use (at a first height), it is possible the extraction of the rods; vice versa, when it is positioned in the second position of use (at a second height lower than the first), the arm prevents the extraction of drilling rods 40 from container 30.

When carriage 50, and then the rod containers, move as a result of the actuation of transmission group 23, rotating arms 71 are all in the second position of use; on the other hand, when one of containers 30 positions in correspondence of an extraction or storage station of drilling rods 40, where there is a handling system 100 later described more in details, an hydraulic-operated opening system 80 provides for opening rotating arm 71 by positioning it in correspondence of the first height for permitting the output of drilling rods 40 from respective container 30.

It is appropriate to specify that in FIG. 2 fall-prevention devices 70 are all positioned in a first configuration of use only for representative effectiveness, but this condition is operatively not realizable.

Figure 9:
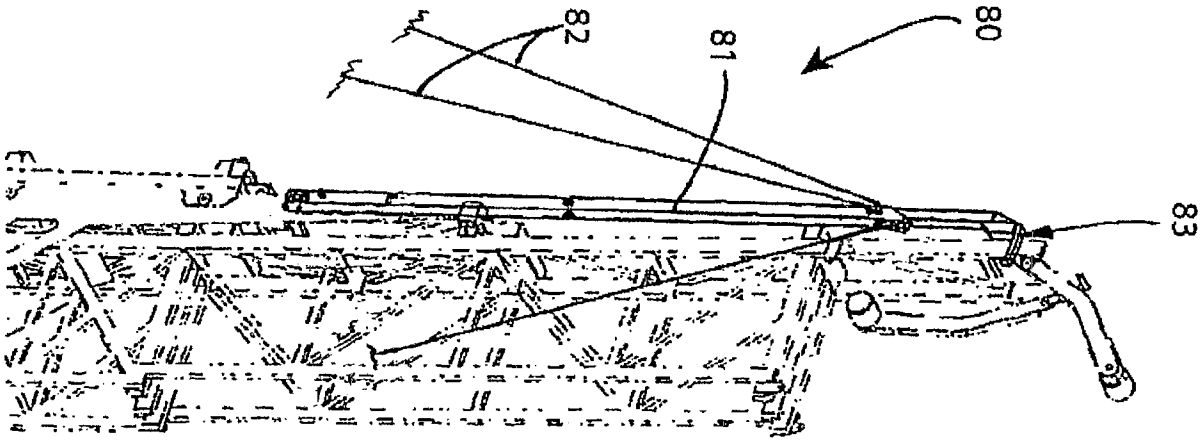
FIG. 9 shows a safety system for the drilling rods contained in the container shown in FIG. 7.

In detail, as shown in FIG. 9, opening system 80 comprises a rod 81 oriented along an axis parallel to axis Z which is kept in this orientation thanks to the help of a plurality of stressable overheads 82.

Upon the top of rod 81, a hooked structure 83 permits the releasable engagement with a part of arm 71, with the consequent switching between the first and the second position of use.

Figure 10:
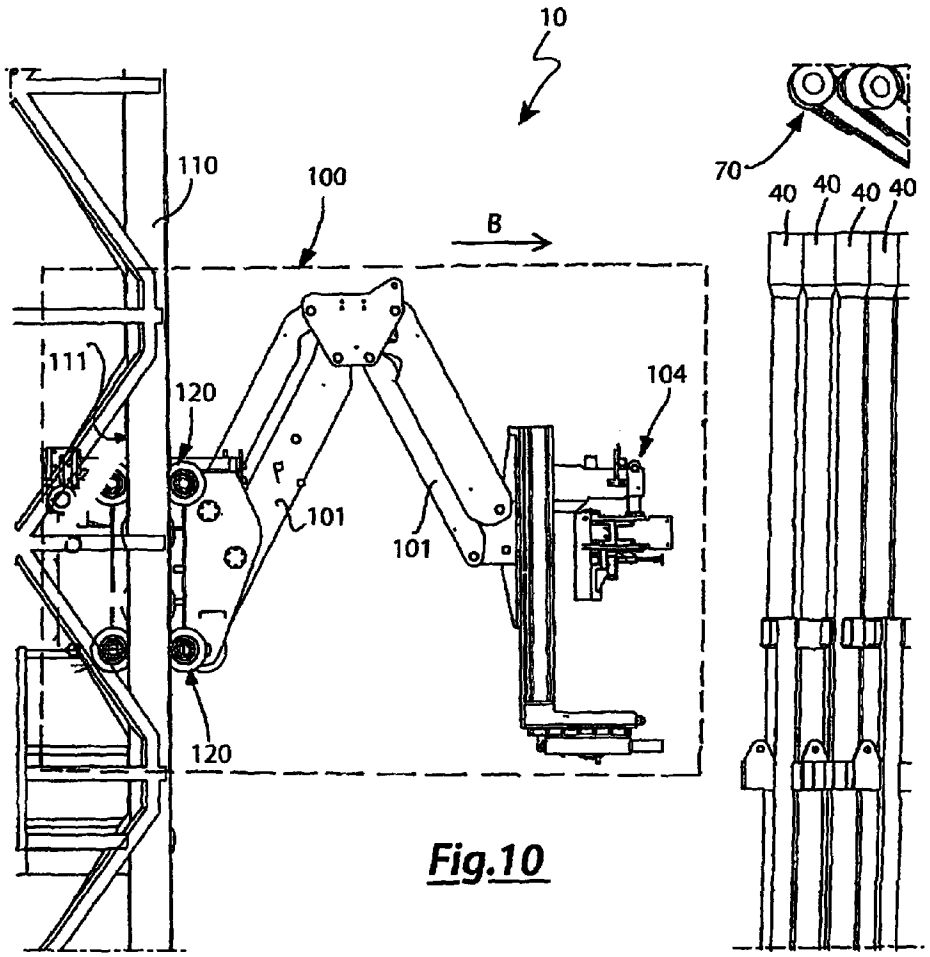
FIG. 10 shows a detail of an arm for handling the drilling rods according to the present invention.

The parking and automatic handling equipment of drilling rods 10 further comprises a rod handling system 100, shown in FIG. 1 and in more details in FIG. 10 which in its first embodiment is designed as follows.

Rod handling system 100 comprises:

- a supporting latticed column 110, arranged on a drilling machine, having a base platform equipped with a rotation fifth wheel for permitting the rotation of a manipulator arm 101, comprising an extendable pantograph, around an axis parallel to axis Z;
- a pair of guides 111 positioned inside latticed column 110;
- a sliding carriage 120, able to move on the guides parallely to axis Z for the vertical sliding of whole handling arm 101;
- a mechanism for the lifting and lowering of the carriage;
- a tong gripping group 104, constrained to the pantograph arm and positioned in detail in correspondence of one outer ending.

Equipment 10 object of the present invention can be mounted, in a first embodiment, on a drilling machine as the one in FIG. 1, wherein thus there are no space limits in front of a drilling well 500; upon this drilling machine then the purpose is to increase the number of drilling rods 40 stored inside carousel 20 keeping at the same time a good speed in the cycle of extraction of rods from containers 30 up to the insertion in well head 500 and, equally, in the cycle of extraction of the rods from the well towards containers 30.

The drilling machine, of known kind and shown in FIG. 1, is equipped with a mast or telescopic shaft 510 along which slides a carriage comprising a lateral extension pantograph; the drilling machine comprises also a head 520 movable orthogonally with respect to axis Z in such a way as to alternatively position between the head of well 500 and a service well 530 parallel to well 500. Service well 530 is technically known as mouse hole and upon it is positioned a hydraulic vice 540 for keeping a drilling rod 40 at a predetermined height with respect to the ground.

The drilling machine is also provided with power tongs, whose purpose is to permit the carrying out of the screwing or unscrewing of the drilling rods 40 positioned in battery within well 500.

In this drilling machine, rod handling system 100 is positioned in front of service well 530 and its arm has an axis coincident with the longitudinal axis of the drilling machine.

Carousel 20 of containers 30 of drilling rods 40 can be positioned parallely to the longitudinal axis of the drilling machine or orthogonally with respect to this last.

In use, a cycle of extraction of a drilling rod 40 from container 30 develops as follow described.

First phase. In a first phase carousel 20 is still and one of the sectors of a container 30 of drilling rods 40 is exactly in correspondence of rod handling system 100.

Second phase. Handling arm 101 poses exactly in axis with the row of drilling rods 40 stored in container 30.

Third phase. The handling arm 101 extends until the gripping tong will enter in contact with a rod.

Fourth phase. At this point the tong closes and carriage 102 upon which the arm is constrained carries out a short rise tract, parallely to axis Z, for detaching drilling rod 40 from the supporting plane.

Fifth phase. The arm retracts and carries out a rotation (preferably of 90° or 180°) according to the arrangement given to containers 30 and aligns with service well 530.

Sixth phase. The arm extends until drilling rod 40 is on the vertical axis of the mouse-hole.

Seventh phase. The carriage of handling arm 101 carries out now a descent for inserting the rod in the hole of service well 530. The final position of the rod provides that the upper tool joint protrudes from the probe plane for a predetermined height (for mere non limitative instance, 1, 5 meters).

Eighth phase. The automatic sequence managed by PLC closes now hydraulic vice 540, which was open. Drilling rod 40 is hanged over service well 530, the tong of the handling arm opens and the arm retracts. At this point it rotates until it is in correspondence of the extraction station, ready to extract another drilling rod 40. At the same time, head 520 is brought on service well 530 and is then carried out the descent until the threaded ending succeeds in screwing on the rod present on service well 530.

Ninth phase. The operator opens vice 540 of service well 530 and begins the ascent of the head to which is now hooked the rod extracted from the mouse-hole. Eventually, it carries out the maneuver of retraction of the pantograph of handling arm 101 and brings head 520 and the rod in axis with the center of main well 500.

Tenth phase. The tenth phase provides the connection of drilling rod 40 extracted from service well 530 to the battery of drilling rods 550 hanged on wedges in the center of the well. The tightening torque necessary for the connection is given by means of the power tong. At this point, the operator lifts the automatic locking wedges of the rod and hangs then the whole rod battery to head 520.

Eleventh phase. At this point it is carried out the descent in well 500. Again the descent will be stopped when the upper tool joint of the rod protrudes from the probe plane for a predetermined height (as mere instance, non limiting, 1, 5 meters). Therefore, the automatic wedges will be immediately inserted for supporting the battery completed with drilling rods. Head 520 is now ready for another cycle.

The cycle of extraction of the drilling rods from well 520 for a successive storage of them in containers is exactly the opposed sequence of what has been previously described.

Handling system 100 object of the present invention can also be mounted on drilling machines of different kind.

Figure 11:
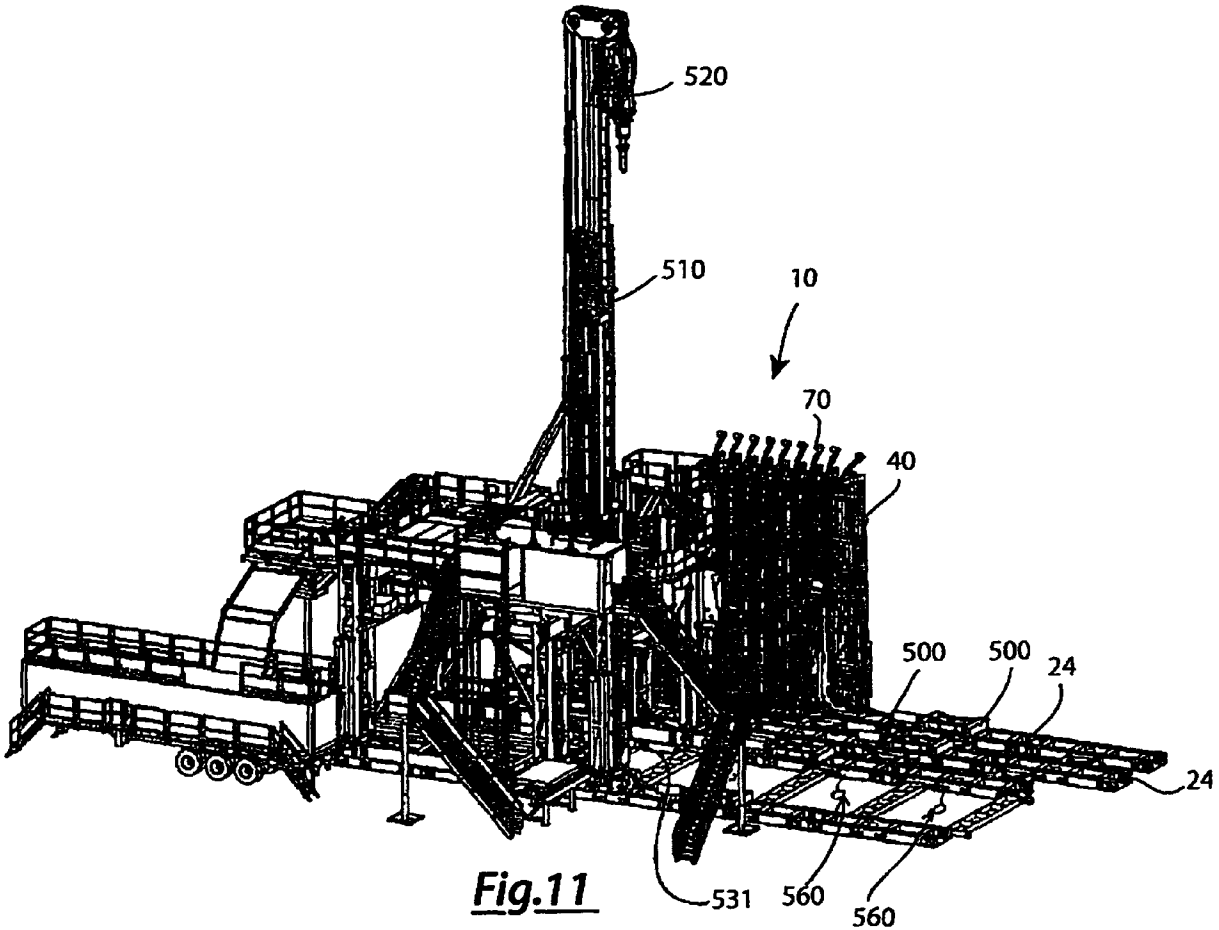
FIG. 11 and FIG. 12 show a perspective view of a second embodiment of a parking and automatic handling equipment of drilling rods according to the present invention respectively as a whole and in details, associated to a drilling machine.
Figure 12:
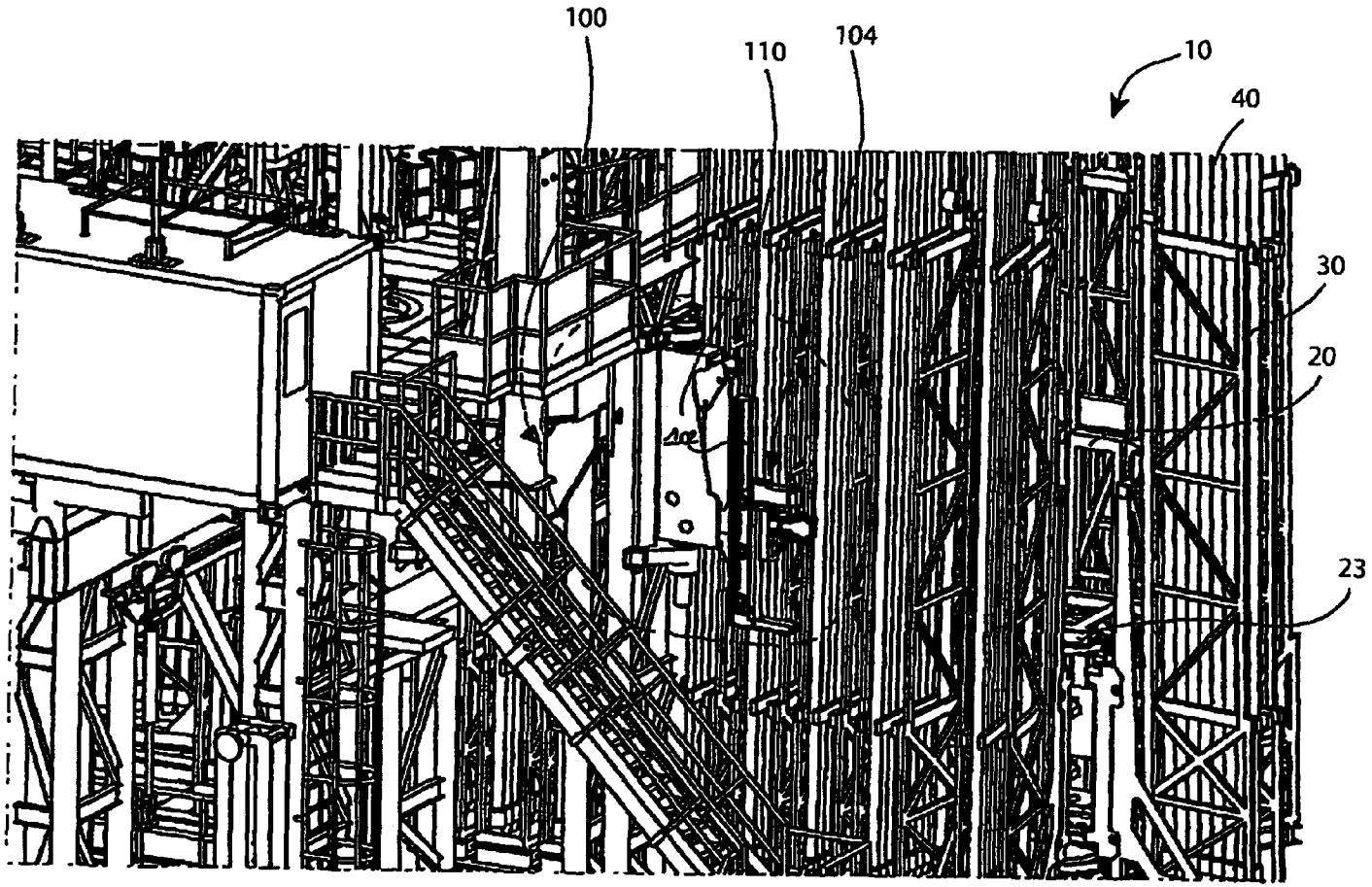
Figure 13:
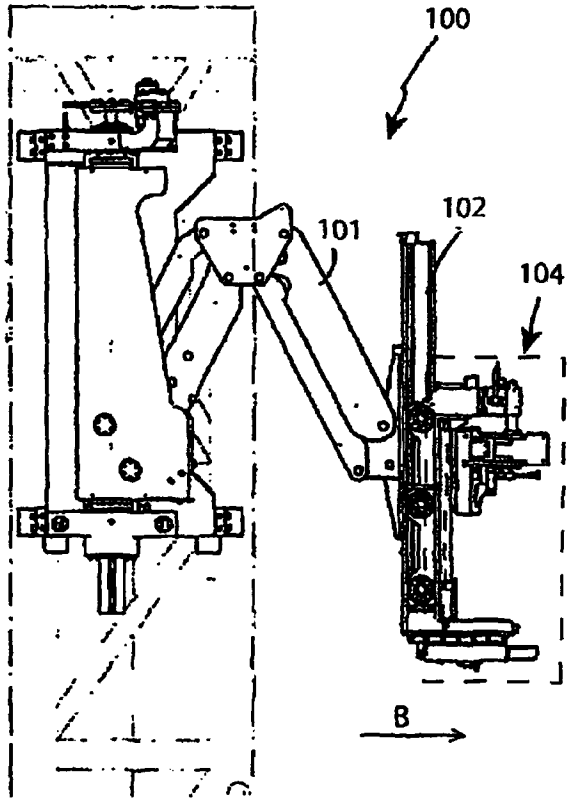
FIG. 13 shows a detail of a second embodiment of a handling system for drilling rods comprised in the equipment object of the present invention.

In particular, the second embodiment of the drilling machine, shown in FIG. 11, differentiates from the previous one for the presence of a plurality of main wells 500 in series (or wells in cluster), which impose some realization constraints of the machine itself and of the related parking and automatic handling equipment of drilling rods 10 object of the present invention.

In particular, the drilling machine shown in FIG. 11, precisely because of the presence of a plurality of drilling wells 500 positioned in series, cannot use anymore the room in front of service well 530 or mouse-hole as previously.

In particular, the second embodiment of the machine object of the present invention can be used for wells for the extraction of fluids of geothermic kind, wherein above each one of main wells 500, are mounted well heads 560 with conveying valves whose overall dimensions can interfere with a drilling machine of traditional kind; for this reason, the second form of embodiment of the drilling machine must above all be lifted above the existing overall dimensions of the "well heads" (valve conveying systems of fluids or gases). Successively, it must be translated on the well 500 upon which it has to intervene and must then be translated from a well to another.

For this reason the second embodiment of the machine object of the present invention comprises a sub-structure characterized by:

base elements longitudinally arranged on the sides of wells 500;

at least two lifting transverse beams of the base machine;

four columns each one provided with a lifting telescopic cylinder.

During the installation phase, the drilling machine object of the present invention it is first lifted at height by means of a front and rear transverse beam and thanks to the help of telescopic cylinders.

Subsequently, these transverse beams are mechanically locked through pins, after which there is a final leveling for making the verticality of mast 510 accurate.

In this case, service well 530 is not anymore carried out in the ground and a rod containing means 531 obtained between a well and the other replaces it. Drilling rod 40 extracted from container 30 can then be lowered until laying on the ground, but it cannot be anymore inserted in the ground itself.

In the second embodiment carousel 20 of containers is arranged parallely to the longitudinal axis of the machine, and positioned in such a way as to be used for the extraction/storage of the rods on at least two wells 500. When the machine translates on the successive well 500, it changes the position of the extraction/storage station, that is, it changes container 30 from which drilling rod 40 is extracted, but the carousel position does not change. Therefore, the path found by carousel 20 of containers 30 must be long enough for permitting the extraction of drilling rods from at least two different extraction stations (and therefore between two different rows of a container 30 or between two or more different containers 30) without handling carousel 20 itself, when a handling of the drilling machine is realized from a well to another.

Handling system 100 is arranged near rod containing means 531. Its handling arm 101 can carry out a general rotation higher than the flat angle) (>180°), starting from a zero position wherein handling arm 101 has a horizontal extensibility axis B coincident with a first container 30 of drilling rods 40.

Differently from the embodiment of the drilling machine previously described, in this case the vertical excursion carried out by drilling rod 40 during its extraction from container 30 for the positioning in rod containing means 531 is realized in a more limited size; therefore, thanks to this reduced excursion, it is no more necessary the presence of a tower for lifting handling system 100, but simply, manipulator arm 101 ends with a slide 102, able to make the tong of extraction of drilling rod 40 realize a vertical excursion parallel to axis Z.

In an operating phase of extraction and storage of rods in rod containing means 531, the arm carries out a rotation for bringing there drilling rod 40 extracted from first container 30.

A typical cycle of extraction for drilling rod 40 from containers 30 up to the insertion in well 500 comprises the following phases.

First phase. Carousel 20 is still and one of the rows of a container 30 of drilling rods 40 is in correspondence of handling arm 101.

Second phase. Handling arm 101 positions itself exactly in axis with the row of drilling rods stored.

Third phase. Handling arm 101 extends until the gripping tong will enter in contact with a drilling rod 40.

Fourth phase. At this point the tong closes and the slide upon which is constrained the tong carries out a short rise tract for detaching the drilling rod from the supporting plane.

Fifth phase: handling arm 101 retracts and carries out a rotation for aligning with rod containing means 531. The arm extends until the rod is on the vertical axis of rod containing means 531. The slide of the tong carries out now a descent for inserting drilling rod 40 into a rod presence device 570, positioned at the level of the ground. The ending position of the drilling rod provides that the upper tool joint protrudes from the probe plane for a predetermined height.

Sixth phase. The automatic sequence managed by PLC closes now the vice of mouse hole 540. The rod is hanged over in rod containing means 531, the tong of handling arm 101 opens and the arm retracts. It then rotates until it is in correspondence of the extraction station, ready to extract another drilling rod 40.

Seventh phase. At the same time, head 520 is brought on rod containing means 531, it is carried out the descent until the threaded ending of the head 520 succeeds in screwing on drilling rod 40 present on rod containing means 531.

Eighth phase. The operator opens the vice of mouse-hole 540 and begins the ascent of the head to which is now hooked the rod extracted from rod containing means 531.

Ninth phase. Eventually, it is carried out a maneuver of retraction of the pantograph of the handling arm and head 520 and drilling rod 40 are brought in axis with the center of well 500.

Tenth phase. The tenth phase provides the connection of drilling rod 40 to the battery of rods hanged on wedges in the center of well 500. The tightening torque necessary for the connection is given by means of the power tong. At this point, the operator lifts the automatic wedges and hangs then the whole battery of drilling rods 40 to head 520. It then carries out the descent in the well. Again the descent will be stopped when the upper tool joint of the last rod protrudes from the probe plane for a predetermined height.

Eleventh phase. The automatic wedges are immediately inserted for supporting the complete battery of drilling rods 40. Head 520 is now ready for another cycle.

At the end of the insertion of drilling rods 40 in well 500, or when it is needed to move on a well 500 adjacent to the one previously worked, only the drilling machine moves whereas carousel 20 remains still.

Obviously, in case the plurality of wells is elevated, equipment 10 object of the present invention can be moved.

Preferably:

if the drilling machine moves from well 500 just worked to the immediately previous or next well, then carousel 20 of drilling rods remains still;

if the drilling machine moves from well 500 just worked to a well more distant than the one immediately previous or next, it will then move also carousel 20, translating parallely to the machine itself.

Generally, however, carousel 20 defines a closed path around which rod containers 30 are arranged radially extending from the direction of chain 23*a*, having a higher length equal to at least the distance between a pair of main drilling wells 500 adjacent.

The advantages of the equipment up to here described are clear in the light of the previous description. In particular, it permits to move carousel 20 of containers of rods along a non circular path, which is then not anymore limited by the maximum size of the extraction arm of the rods, or of the handling arm, inside the circumference arch as occurred in the known art; the carousel not only can rotate along a determined path but also the entire equipment can slide for permitting the positioning of a container of rods in front of the handling arm, in particular in case of association to drilling machines operating and self-propelled on a series of drilling rods.

To the equipment up to here described it can be applied some variants obvious for an expert in the art, without departing from the protective scope of the attached claims.

The invention claimed is:

1. A machine for parking and automatic handling of drilling rods, comprising:

a carousel of containers of drilling rods; each of the containers comprising a carriage; and a rod handling system, positioned on a drilling machine, and comprising a handling arm for transfer of said drilling rods out of said carousel;

said carousel defines a closed path around which are arranged said containers of drilling rods; said carousel comprising an internal structure for supporting said containers; said containers being movable and rotating upon said closed path with respect to said internal structure;

said closed path being oblong and defining a direction of maximum extension having a length equal to at least a distance between a pair of adjacent drilling wells within which said drilling rods are inserted;

said carousel comprising a plurality of fall prevention devices for preventing said drilling rods from falling from said carriages; a quantity of said fall prevention devices being at least equal to a quantity of said containers;

each of said containers comprising a plurality of rows of drilling rods, wherein the quantity of said fall prevention devices equals a quantity of the rows of each of said containers;

each of said fall prevention devices comprises a rotating arm having a counterweight and rotating about a horizontal axis; each of said fall prevention devices comprising a first open position and a second closed position and being moved from said second position to said first position by an opening system when said container is in correspondence with said handling system.

2. The machine according to claim 1, wherein said containers radially extend with respect to said path.

3. The machine according to claim 1, wherein said transmission group comprises at least one chain and a pair of gears operated by at least an electric motor.

4. The machine according to claim 1, comprising a plurality of supporting carriages of said containers; said carriages comprising an L-shaped-structure for supporting said containers.

5. The machine according to claim 3, wherein each of said carriages is engaged on at least one of said at least one chain.

6. A drilling machine comprising the machine for parking and automatic handling of drilling rods according to claim 1.

7. The drilling machine according to claim 6, wherein the drilling machine is fixed and comprises a head slidingly constrained to a drilling shaft and wherein said head is movable from a first position standing over a main well and a second position standing over an auxiliary well created in the ground.

8. The drilling machine according to claim 6, wherein the drilling machine is movable with respect to the ground and comprises a head slidingly constrained to a drilling shaft and wherein said head is movable between a first position overhanging a well of a plurality of wells arranged in series and a second position overhanging constraint means of a drilling rod positioned outside the ground.

* * * * *